US005221194A

United States Patent [19]

Konieczynski et al.

[11] Patent Number: 5,221,194

[45] Date of Patent: Jun. 22, 1993

[54] APPARATUS FOR ELECTROSTATICALLY ISOLATING AND PUMPING CONDUCTIVE COATING MATERIALS

[75] Inventors: Ronald D. Konieczynski, North Royalton; Kenneth J. Coeling, Westlake; Ronald J. Hartle, Amherst, all of Ohio

[73] Assignee: Nordson Corporation, Westlake, Ohio

[21] Appl. No.: 618,089

[22] Filed: Nov. 26, 1990

Related U.S. Application Data

[63] Continuation-in-part of Ser. No. 554,795, Jul. 18, 1990, Pat. No. 5,078,168.

[51] Int. Cl.[5] ..... F04B 21/04

[52] U.S. Cl. ..... 417/430; 92/86; 92/158; 137/565; 137/613; 239/708

[58] Field of Search ..... 417/430; 92/82, 86, 92/87, 158, 159, 110; 239/690, 691, 708; 137/613, 614, 561 R, 565, 566

[56] References Cited

U.S. PATENT DOCUMENTS

| | | | |
|---|---|---|---|
| 277,305 | 5/1883 | Maltby | 92/86 |
| 482,776 | 9/1892 | Avery | 92/86 |
| 648,153 | 4/1900 | Serve | 92/82 |
| 1,549,332 | 8/1925 | Roberts | 92/86 |
| 2,811,950 | 11/1957 | Entz | 92/86 |
| 2,828,610 | 4/1958 | Bruehl | 92/86 |
| 3,063,423 | 11/1962 | Riordan | 92/86 |
| 3,104,619 | 9/1963 | Swarthout | 92/87 |
| 3,315,899 | 4/1967 | Quarve | 239/586 |
| 3,747,850 | 7/1973 | Hastings et al. | 239/3 |
| 3,818,807 | 6/1974 | Semple | 92/86.5 |
| 3,895,748 | 7/1975 | Klingenberg | 222/571 |
| 3,929,286 | 12/1975 | Hastings et al. | 239/3 |
| 3,971,337 | 7/1976 | Hastings | 118/629 |
| 3,999,691 | 12/1976 | Doom | 222/330 |
| 4,004,717 | 1/1977 | Wanke | 222/255 |
| 4,017,029 | 4/1977 | Walberg | 239/15 |
| 4,020,866 | 5/1977 | Wiggins | 137/592 |
| 4,053,012 | 10/1977 | Farmer | 164/254 |
| 4,085,892 | 4/1978 | Dalton | 239/15 |
| 4,124,163 | 11/1978 | Siegmann | 239/533.15 |
| 4,138,931 | 2/1979 | Hermann | 417/430 |
| 4,142,707 | 3/1979 | Bjorklund | 251/77 |
| 4,275,834 | 6/1981 | Spanjersberg et al. | 239/3 |
| 4,313,475 | 2/1982 | Wiggins | 141/18 |
| 4,489,893 | 12/1984 | Smead | 239/691 |
| 4,544,570 | 10/1985 | Plunkett et al. | 427/27 |
| 4,629,119 | 12/1986 | Plunkett et al. | 239/63 |
| 4,660,598 | 4/1987 | Butterfield et al. | 137/510 |

FOREIGN PATENT DOCUMENTS

| | | | |
|---|---|---|---|
| 2853347 | 11/1978 | Fed. Rep. of Germany | 92/87 |

*Primary Examiner*—Richard A. Bertsch
*Assistant Examiner*—Peter Korytnyk
*Attorney, Agent, or Firm*—Ruden, Barnett, McClosky, Smith, Schuster & Russell

[57] ABSTRACT

An apparatus for transferring electrically conductive coating materials such as water-based paint from a source to an electrostatically charged dispenser includes first and second shuttle devices and two large reservoir, piston pumps each having structure for preventing contamination of the coating material and pressure build-up at their piston heads. The first shuttle device is movable between a neutral position wherein it is electrically isolated from a filling station connected to the coating material source, and a transfer position wherein coating material is transmitted to one of the piston pumps through a coupling device which connects the filling station and first shuttle. The second shuttle device is movable with respect to a discharge station between a neutral position wherein the second shuttle is spaced from the discharge station, and a transfer position wherein coating material is transmitted from the filled piston pump, through another coupling device which connects the second shuttle and discharge station and then to the second piston pump for transmission to one or more electrostatic coating dispensers. Movement of the shuttle is controlled to maintain one of the shuttles in the neutral position while the other is at the transfer position.

6 Claims, 7 Drawing Sheets

APPARATUS FOR ELECTROSTATICALLY ISOLATING AND PUMPING CONDUCTIVE COATING MATERIALS

This is a continuation-in-part application of Ser. No. 07/554,795, filed July 18, 1990, now U.S. Pat. No. 5,078,168 and entitled "Apparatus For Electrostatically Isolating Conductive Coating Materials", which is owned by the assignee of this invention.

FIELD OF THE INVENTION

This invention relates to electrostatic spray coating, and, more particularly, to an apparatus for electrostatically isolating a source of supply of conductive coating materials from electrostatic coating dispensers, and for pumping such coating materials between the source and dispensers.

BACKGROUND OF THE INVENTION

The application of coating materials using electrostatic spraying techniques has been practiced in industry for many years. In these applications, the coating material is discharged in atomized form, and an electrostatic charge is imparted to the atomized particles which are then directed toward a substrate maintained at a different potential to establish an electrostatic attraction for the charged atomized particles. In the past, coating materials of the solvent-based variety, such as varnishes, lacquers, enamels, and the like, were the primary materials employed in electrostatic coating applications. The problem with such coating materials is that they create an atmosphere which is both explosive and toxic. The explosive nature of the environment presents a safety hazard should a spark inadvertently be generated, such as by accidentally grounding the nozzle of the spray gun, which can ignite the solvent in the atmosphere causing an explosion. The toxic nature of the workplace atmosphere created by solvent coating materials can be a health hazard should an employee inhale solvent vapors.

As a result of the problems with solvent-based coatings, the recent trend has been to switch to water-based coatings which reduce the problems of explosiveness and toxicity. Unfortunately, the switch from electrostatically spraying solvent-based coatings to those of the water-based type has sharply increased the risk of electrical shock, which risk was relatively minor with solvent-based coatings. The risk of electrical shock is occasioned in the use of water-based coatings due to their extreme electrical conductivity, with resistivities of such water-based coatings often falling within the range of 100 to 10,000 ohm centimeters. This is in contrast to resistivities of 200,000 to 100,000,000 ohm centimeters for moderately electrically conductive coatings such as metallic paint, and resistivities exceeding 100,000,000 ohm centimeters for solvent-based lacquers, varnishes, enamels and the like.

The relative resistivity of the coating material is critical to the potential electrical shock which may arise during an electrostatic coating operation. With coating materials which are either not electrically conductive or only moderately electrically conductive, the column of coating material which extends from the charging electrode at the tip of the coating dispenser through the hose leading back to the supply tank has sufficient electrical resistance to prevent any significant electrostatic charging of the material in the supply tank or the tank itself. However, when coating material is highly electrically conductive, as are water-based coatings, the resistance of the coating column in the supply hose is very low. As a result, a high voltage charging electrode located in the vicinity of the nozzle of the coating dispenser electrostatically charges not only the coating particles, but the coating material in the hose, the coating material in the supply tank and the supply tank itself. Under these circumstances, operating personnel inadvertently coming into contact with an exposed supply tank or a charged hose or any other charged part of the system risk serious electrical shock unless such equipment is grounded to draw off the electricity. If the equipment is indeed grounded at any point, however, the electrostatics will not function because the high voltage charge would be conducted away from the coating dispenser electrode as well.

One of the methods for reducing the electrical shock problem is disclosed, for example, in U.S. Pat. No. 3,971,337 to Hastings which is owned by the same assignee as this invention. The Hastings patent discloses an apparatus for electrostatically isolating the supply tank which is connected to the coating dispenser. While this device is satisfactory for batch operations, it does not readily lend itself to continuous painting lines, i.e., applications wherein an essentially continuous supply of coating material must be provided over a period of time.

This problem has been addressed in apparatus of the type disclosed, for example, in U.S. Pat. No. 4,313,475 to Wiggins. In apparatus of this type, a "voltage block" system is employed wherein electrically conductive coating material is first transmitted from a primary coating supply into a transfer vessel which is electrically isolated from the spray gun. When filled with coating material, the transfer vessel is first disconnected from the primary coating supply and then connected to an inventory tank, which, in turn, is connected to one or more coating dispensers. The coating material is transmitted from the transfer vessel into the inventory tank to fill the inventory tank with a supply of coating material for subsequent transfer to the coating dispensers. While the inventory tank supplies the coating dispensers with coating material, the transfer vessel is disconnected from the inventory tank and connected back to the primary coating supply to receive another quantity of coating material so that the coating operation can proceed essentially continuously.

An important feature of apparatus of the type disclosed in the Wiggins U.S. Pat. No. 4,313,475 is that a voltage block or air gap is provided at all times between the primary source of coating material and the electrically charged coating dispensers. One potential operational problem with the Wiggins design is that separately actuated transfer devices, e.g., pneumatic cylinders or the like, are employed to interconnect the transfer vessel with the primary coating supply, and then to connect the transfer vessel with the inventory tank. Because the two pneumatic cylinders or other transfer devices are actuated independently of one another, it is possible that a malfunction of the controller for such cylinders could result in the connection of the transfer vessel to the primary coating supply at the same time the inventory tank is connected to the transfer vessel. As discussed above, the low resistivity of water-based coating materials can result in the transfer of a high voltage electrostatic charge from the coating guns, through a column of coating material to the primary coating supply, thus creating a hazard of electrical shock.

Another problem with apparatus such as disclosed in Wiggins U.S. Pat. No. 4,313,475 involves the leakage and/or drippage of coating material during the transfer process. As described above, the transfer vessel receives a supply of coating material from the primary coating supply, disengages the coating supply and then engages the inventory tank to transfer the coating material therein for supply to the coating dispensers. In the course of this transfer operation, the transfer vessel must make and break connections at both the primary coating supply and the inventory tank in order to effect the transfer of the coating material. It has been found that the connections and/or valving arrangements employed in such apparatus are susceptible to leakage and/or drippage, and thus present clean-up problems. In addition, leakage of such connections can result in grounding and thus loss of voltage in the electrostatic coating dispensers, and also could create an electrical shock hazard should a stream of dripping coating material contact an ungrounded object which can be touched by the operator.

Other potential operational problems with apparatus of the type disclosed in the Wiggins U.S. Pat. No. 4,313,475 involve handling of the coating material within the system. In such apparatus, the coating material is allowed to pool or come to rest within the transfer vessel and/or inventory tank. The pigments within coating material such as paints tend to settle if allowed to come to rest within a vessel or tank, and apparatus of the type disclosed in the Wiggins patent provide no means of circulating or moving the coating material within either the transfer vessel or inventory tank to maintain the pigments and other solids in suspension.

Another problem with systems of the type disclosed in the Wiggins U.S. Pat. No. 4,313,475 is that when the coating material such as paint is transferred between the vessels and tanks of the Wiggins apparatus, and to the coating dispensers, such movement is obtained by the application of pressurized air within the vessel or tank directly into contact with the coating material to force it from the vessel. An air interface can degrade many types of paints, and it is desirable to avoid contact with air until the coating material is applied to a particular substrate.

One way of avoiding direct air contact with the paint is to employ a piston pump having a cylindrical wall defining a reservoir with a piston movable therein. Air or other operating fluid is applied to one side of the piston which forces paint located on the other side of the piston out of the reservoir. In these types of piston pumps, the piston head is formed with one or more circumferential grooves, each of which carry a seal in a position to slidably engage the walls of the cylinder. While piston pumps of this type avoid the problem of direct contact of air and paint, other limitations have been observed in their operation.

One problem with piston pumps of the type described above is that the seals on the piston head are not effective to completely wipe the cylinder wall clean of paint as the piston reciprocates within the reservoir. As a result, a thin film of paint can form along the cylinder wall which is dried by contact with the operating air introduced into the reservoir as the piston is reciprocated therein. This dried paint leaves an abrasive, high friction residue on the cylinder wall which can create erratic piston motion and lead to premature failure of the seals. Additionally, such paint deposits can get sufficiently tacky or sticky to substantially restrict the motion of the piston, particularly if the system operation is interrupted for a period of time for any reason.

Another problem with piston pumps of the type described above is a phenomenon known as "pressure trap". This condition is caused by a differential rate of wiping of the coating material from the walls of the cylinder where the piston head is provided with two or more circumferentially extending seals which are axially spaced from one another. A reservoir of coating material can build up in the axial space(s) between the seals which forces the seal opposite the pressurized side of the piston against its groove in the piston head. For example, when pressurized air is introduced into the reservoir of the pump on one side of the piston head, the coating material caught within the axial space between the seals is forced in a direction toward the coating material side of the piston, which, in turn, forces the seal closest to the coating material against the lip of the groove in the piston head. When the opposite side of the piston head is pressurized, e.g., upon the receipt of coating material, the coating material captured between the seals is forced in the opposite direction, toward the air side of the piston head, thus causing the seal closest to the air side to be forced against its groove in the piston head. This problem of pressure trap causes additional drag on the system and accelerated seal wear.

SUMMARY OF THE INVENTION

It is therefore among the objectives of this invention to provide an apparatus for dispensing highly electrically conductive coating material, such as water-based paint, which protects against the transmission of an electrostatic charge from the coating dispensers to the primary coating supply, which circulates the coating material to avoid settling, which reduces drippage and clean-up problems, which is easily cleaned and which provides for positive pumping of the coating material without contamination with air and without premature pump seal wear.

These objectives are accomplished in an apparatus for transferring electrically conductive coating materials such as water-based paint from a source to an electrostatically charged dispenser or spray gun which includes first and second shuttle devices, and a large reservoir, piston pump connected between the shuttle devices. The first shuttle device is movable with respect to a filling station between a transfer position coupled to the filling station and a neutral position spaced from the filling station. One of the first shuttle device and the filling station is connected to the coating source, and the other is connected to the piston pump. The second shuttle device is movable with respect to a discharge station between a transfer position coupled to the discharge station and a neutral position spaced from the discharge station. One of the second shuttle and discharge station is connected to the piston pump and the other communicates with one or more electrostatic coating dispensers. The coating material is transmitted from the first shuttle device and filling station to the piston pump, and then directed from the piston pump through the second shuttle device and discharge station to one or more electrostatic spray guns.

An important aspect of this invention is predicated upon the concept of controlling the movement of the first and second shuttle devices such that a "voltage block" or air gap is continuously maintained between the source of water-based paint and the electrostatic spray guns during a coating operation. This voltage block is obtained by ensuring that when the first shuttle device is coupled to the filling station for the transfer of coating material into the piston pump, the second shuttle device is electrically isolated, i.e., in the physically spaced neutral position, from the discharge station. On the other hand, when coating material is transferred from the piston pump, through the second shuttle device and discharge station to the spray gun, the first shuttle device is physically spaced and electrically isolated from the filling station. In this manner, the first and second shuttle devices are never in contact with the filling station and discharge station, respectively, at the same time during a coating operation.

Movement of the first and second shuttle devices with respect to the filling station and discharge station, respectively, is obtained by a system of pneumatically and/or mechanically operated valves. The valving system controls essentially two distinct operations associated with the transfer of coating material from the source to the electrostatic spray guns. In one sequence of operation, coating material is transferred from the source into the large reservoir, piston pump. This is achieved by moving the first shuttle to a transfer position in engagement with the filling station wherein coating material from the source flows into the filling station, through the first shuttle and then through a line to the piston pump. At the same time, the valving system moves the second shuttle device to the neutral position in which it is physically spaced from the discharge station and thus electrically isolated therefrom.

Once the piston pump is filled with coating material, a second sequence of operation of the valving system simultaneously moves the first shuttle to a neutral position away from the filling station, and moves the second shuttle into a transfer position in contact with the discharge station. Coating material is then discharged from the piston pump through the second shuttle and discharge station to a second piston pump, which, in the presently preferred embodiment, is located between the second shuttle device and one or more electrostatic spray guns. After the supply of coating material from the first piston pump has been exhausted, the valving system resets to its original position and resumes filling of the first piston pump as described above.

In the presently preferred embodiment of this invention, the valving system is also operated by a controller to provide for flushing of the entire transfer system by a solvent or the like. In this mode of operation, both of the shuttle devices are temporarily moved into engagement with the filling station and discharge station, respectively.

In another aspect of this invention, the large reservoir, piston pumps associated with the apparatus of this invention are designed to essentially continuously circulate the coating material therein to avoid settling of sediment or pigments, and to permit easy cleaning of the piston pumps. In the presently preferred embodiment, coating material is introduced at the bottom of the reservoir of the piston pumps, along a flow path which is substantially tangent to the outer wall thereof, such that the coating material circulates or swirls along the inner surface of the reservoir of the piston pump to help pigments and other sediments within the coating material remain in suspension. Additionally, the bottom surface of the reservoir of the piston pump is dished or concave in shape and the discharge outlet of the pump is at the center of this dished surface. This eliminates low pockets within which sediment or pigment can accumulate as coating material is discharged out of the piston pump. Preferably, the piston head bottoms out with the base of the reservoir during the solvent cleaning operation which squeezes the solvent at high velocity through the discharge outlet to ensure complete cleaning of the reservoir.

Another advantage of the reservoir pump of this invention involves the isolation of the paint from air. The paint is transmitted in lines, and through the shuttle device and filling station, directly into the reservoir of the piston pump. The piston pump includes a piston head, axially movable within the reservoir, which substantially seals the paint flowing into and out of the reservoir from contact with air. Since some paints tend to degrade when exposed to air, the sealed pump reservoir is effective to avoid that problem.

A still further advantage is provided by the piston pump of this invention which overcomes many of the problems with typical air-operated piston pumps of the type described above. In the presently preferred embodiment, the piston pump includes a piston shaft having one end connected to the piston head, and a second end extending outwardly from the reservoir. The piston shaft is formed with a bore which enters the piston head and intersects at least four branch passageways formed therein. These passageways extend radially outwardly from the piston shaft bore to the outer periphery of the piston head at a location between two annular, circumferential grooves formed therein, each of which carry a piston seal. The end of the piston shaft extending outwardly from the reservoir is preferably connected by a fitting to a section of plastic tubing having a vented cap which contains a lubricating fluid such as water.

The formation of a bore in the piston shaft and branch passageways in the piston head provides several advantages. First, water is transmitted at ambient pressure from the tubing, through the bore in the piston shaft, and radially outwardly within each of the branch passageways to the outer periphery of the piston head in between the piston seals. The water forms a lubricant along the cylinder walls to facilitate movement of the piston within the cylinder. The presence of water between the seals also prevents cross contamination between the paint and air sides of the piston head. Any air which might leak past one of the seals is captured within the water between the seals and eventually flows upstream along the branch passageways and bore in the piston shaft to the plastic tube where it is vented. Similarly, any coating material which leaks past either seal is mixed with the water in the space between the seals and eventually flows upstream along the branch passageways and piston shaft bore to the plastic tube. The presence of paint within the water lubricant can be visually detected in the plastic tube, and, when it reaches a predetermined maximum amount, the bore in the piston shaft and the branch passageways in the piston head can be flushed and filled with clean water.

Another advantage of transmitting water at ambient pressure into the axial space between the seals in the piston head is to eliminate the "pressure trap" problem described above which leads to premature seal wear. The lips of the seals are permitted to fully press against the cylinder wall because pressure between the seals is relieved through the branch passageways and the piston shaft bore. This not only reduces seal wear, but creates an improved seal against the cylinder wall.

In another aspect of this invention, a coupling device is provided to interconnect the filling station and first shuttle, and to interconnect the discharge station and second shuttle. As mentioned above, each of the first and second shuttles are movable with respect to the filling station and discharge station, respectively, to transfer coating material to or from the piston pump interposed therebetween. After coating material has been transferred through each of the first and second shuttles, they must be disengaged from the respective filling or discharge stations to provide the voltage block described above. In order to create a fluid-tight seal at the filling and discharge stations, and to avoid drippage of coating material when the shuttles disengage the filling or discharge stations, a coupling device is provided having mating male and female coupling members which engage one another with a three-part seal to avoid leakage. Additionally, the female coupling member is effective to "snuff back" or draw a vacuum at the outer end thereof which pulls in any excess coating material present at the outer portions of the male and female coupling members when they are decoupled. The creation of a suction or negative pressure at the outer end of the female coupling member avoids drippage of coating material onto the floor, or the apparatus herein, avoiding time-consuming clean-up and the potential problems of grounding the coating dispensers and/or creating an electrical shock hazard.

DESCRIPTION OF THE DRAWINGS

The structure, operation and advantages of this invention will become further apparent upon consideration of the following description, taken in conjunction with the accompanying drawings, wherein.

DETAILED DESCRIPTION OF THE PREFERRED EMBODIMENT

Referring now to the Figs., the apparatus 10 of this invention is particularly adapted for use with highly electrically conductive coating materials such as water-based paints, and is constructed to permit the transfer of such coating material from a source to an electrostatic spray gun without creating an electric shock hazard or loss of charge at the coating dispenser electrode caused by a ground at any of the equipment that is wetted by the coating material such as pumps, hoses and tanks. The overall construction of the apparatus 10 is discussed initially, and specific aspects of the apparatus are described separately.

OVERALL SYSTEM CONSTRUCTION

Figure 1:
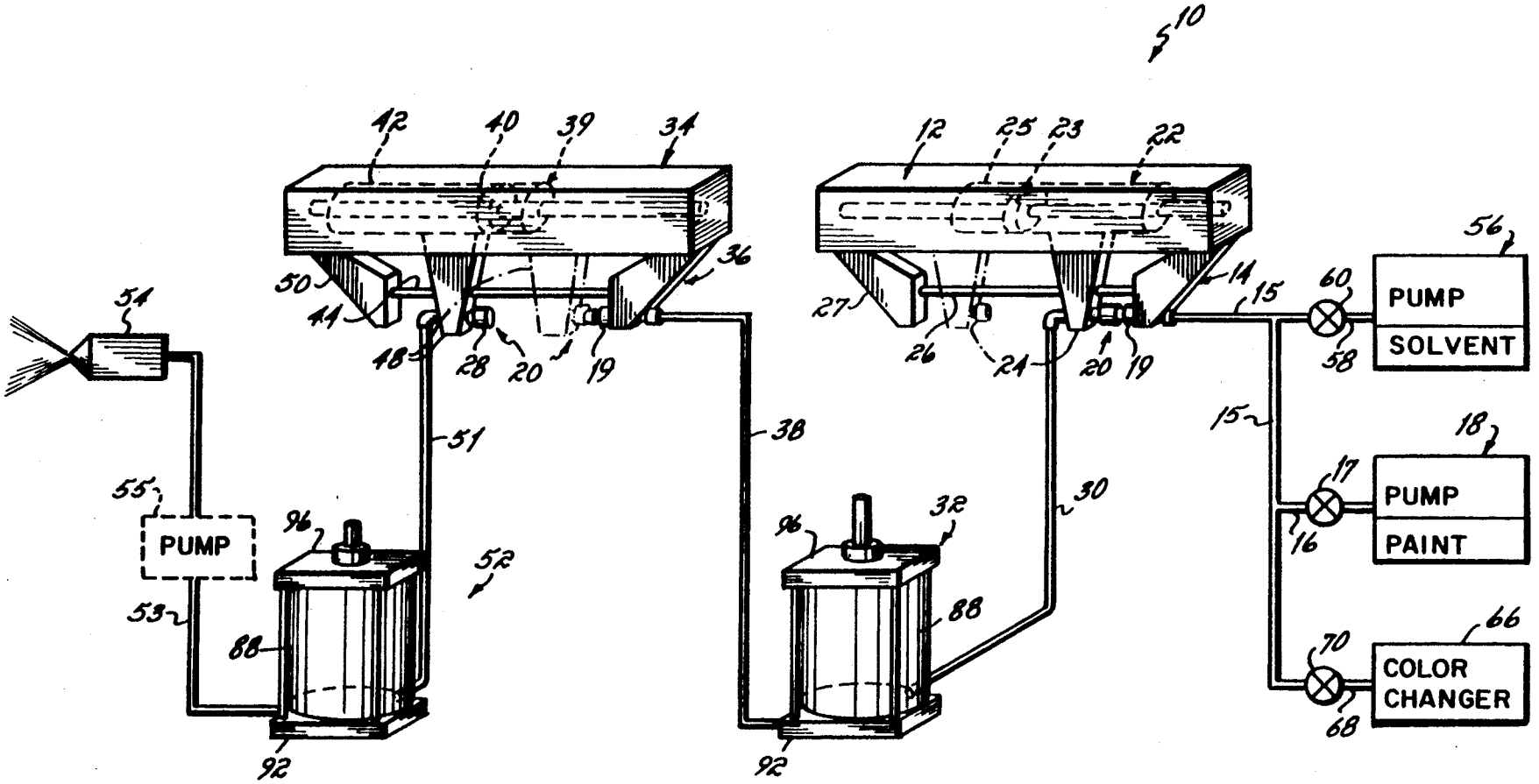
FIG. 1 is a diagrammatic view of the overall construction of the apparatus of this invention.

With reference to FIG. 1, the apparatus 10 generally comprises a first housing 12 having a filling station 14 connected by a main paint supply line 15 through a branch line 16 and valve 17 to a pump and source 18 of electrically conductive coating material such as water-based paint. The filling station 14 mounts the male coupling member 19 of a coupling device 20, described in detail below, which connects to the supply lines 15 and 16.

A double-acting piston 22 is carried within the first housing 12 having a fixed piston assembly 23 and a movable cylinder 25 which is connected to a first shuttle 24. The first shuttle 24 is movable along a guide rod 26, carried between the filling station 14 and a block 27, in response to reciprocation of the cylinder 25 relative to the fixed piston assembly 23, as described below. The shuttle 24 mounts the female coupling member 28 of coupling device 20, and this female couple element 28 is connected by a transfer line 30 to a first piston pump 32.

As described in detail below, the shuttle 24 is movable with respect to the filling station 14 between a "transfer" position in which the female coupling member 20 carried by the shuttle 24 engages the male coupling member 19 carried by the filling station 14, and a "neutral" position shown in phantom in FIG. 1 wherein the shuttle 24 is spaced and electrically isolated from the filling station 14. In the transfer position, the shuttle 24 is effective to receive paint from the source 18, supply line 15 and filling station 14, and transmit the paint through transfer line 30 to the first piston pump 32.

The apparatus 10 of this invention also comprises a second housing 34 having a discharge station 36 which is connected by a transfer line 38 to the first piston pump 32. The second housing 34 is equipped with a double-acting piston 39 having a fixed piston assembly 40 and a movable cylinder 42 which mounts a shuttle 48. In response to reciprocation of the cylinder 42 relative to the piston assembly 40, as described below, the shuttle 48 is movable along a guide rod 44 mounted between the discharge station 36 and a mounting block 50 carried by the housing 34. Preferably, the discharge station 36 mounts the male coupling member 19 of a coupling device 20 identical to that described above, and the shuttle 48 carries a female coupling member 28 in the same fashion as shuttle 24. The male coupling member 19 is connected to transfer line 38, and the female coupling member 28 associated with shuttle 48 is connected by a line 51 to a second piston pump 52. This second piston pump 52, in turn, is connected by a line 53 to an electrostatic spray gun 54.

In the embodiment illustrated in FIG. 1, the apparatus 10 is adapted for use with an air-type electrostatic spray gun 54, i.e., one in which atomization of the paint takes place by impacting a stream of paint with one or more jets of air. These types of spray guns are available commercially, and one air-type electrostatic spray gun suitable for use with apparatus 10 is a Model No. AN-9 sold by Nordson Corporation of Amherst, Ohio, which is the assignee of this invention. Alternatively, the apparatus 10 can be adapted for use with airless-type electrostatic spray guns wherein atomization is obtained hydraulically, and one example of a suitable airless spray gun which can be used with apparatus 10 is found in U.S. Pat. No. 4,355,764, owned by the assignee of this invention. When using airless spray guns, or in applications where a large number of air-type spray guns are employed, a high pressure pump 55 is preferably interposed in the line 53 between the second piston pump 52 and spray gun 54. This pump 55 is used to boost the pressure of the paint exiting pump 52 before it is delivered to the spray gun(s) 54.

As described in detail below in connection with a discussion of the operation of apparatus 10, the function of the shuttles 24, 48 is to transmit coating material from the coating source 18 to one or more electrostatic spray guns 54 while continuously maintaining a voltage block or air space between one of the shuttles 24, 48 and the filling or discharge stations 14, 36, respectively. A valving system is provided to ensure that when the shuttle 24 is in the transfer position with respect to filling station 14 to permit the transfer of coating from source 18 into first piston pump 32, the shuttle 48 is in the neutral position with respect to the discharge station 36, thus forming an air gap which electrically isolates the shuttle 48 from discharge station 36 and electrostatic spray gun 54. The valving structure described below is also effective to reverse the positions of shuttle 24 and shuttle 48 when the coating material is transferred from the first piston pump 32 to the second piston pump and then to spray gun 54. That is, when the shuttle 48 is in a transfer position with respect to discharge station 36, shown in phantom in FIG. 1, the shuttle 24 is in a neutral position, also shown in phantom, wherein an air gap is provided between shuttle 24 and filling station 14 to electrically isolate the shuttle 24 therefrom.

As described below, the apparatus 10 of this invention is cleaned by transmitting solvent from a pump and solvent source 56 into the paint supply line 16, and then through those elements of apparatus 10 which come into contact with the paint. As schematically depicted in FIG. 1, the solvent source 56 is connected through a branch line 58 and valve 60 to the supply line 16 for cleaning purposes, during which time the valve 17, located in the branch line 16 connected to the coating source 18, is closed. The apparatus 10 of this invention can be used with a color changer 66 of the type disclosed, for example, in U.S. Pat. Nos. 4,627,465 and 4,657,047, both owned by the assignee of this invention. The color changer 66 is connected by a branch line 68 carrying a valve 70 to the paint supply line 16 leading the apparatus 10. As described in detail below, if different colors are desired to be dispensed from the spray gun 54, the apparatus 10 is first cleaned with solvent and then a different color is introduced into the apparatus 10 via color changer 66.

SYSTEM OPERATION

Figure 2:
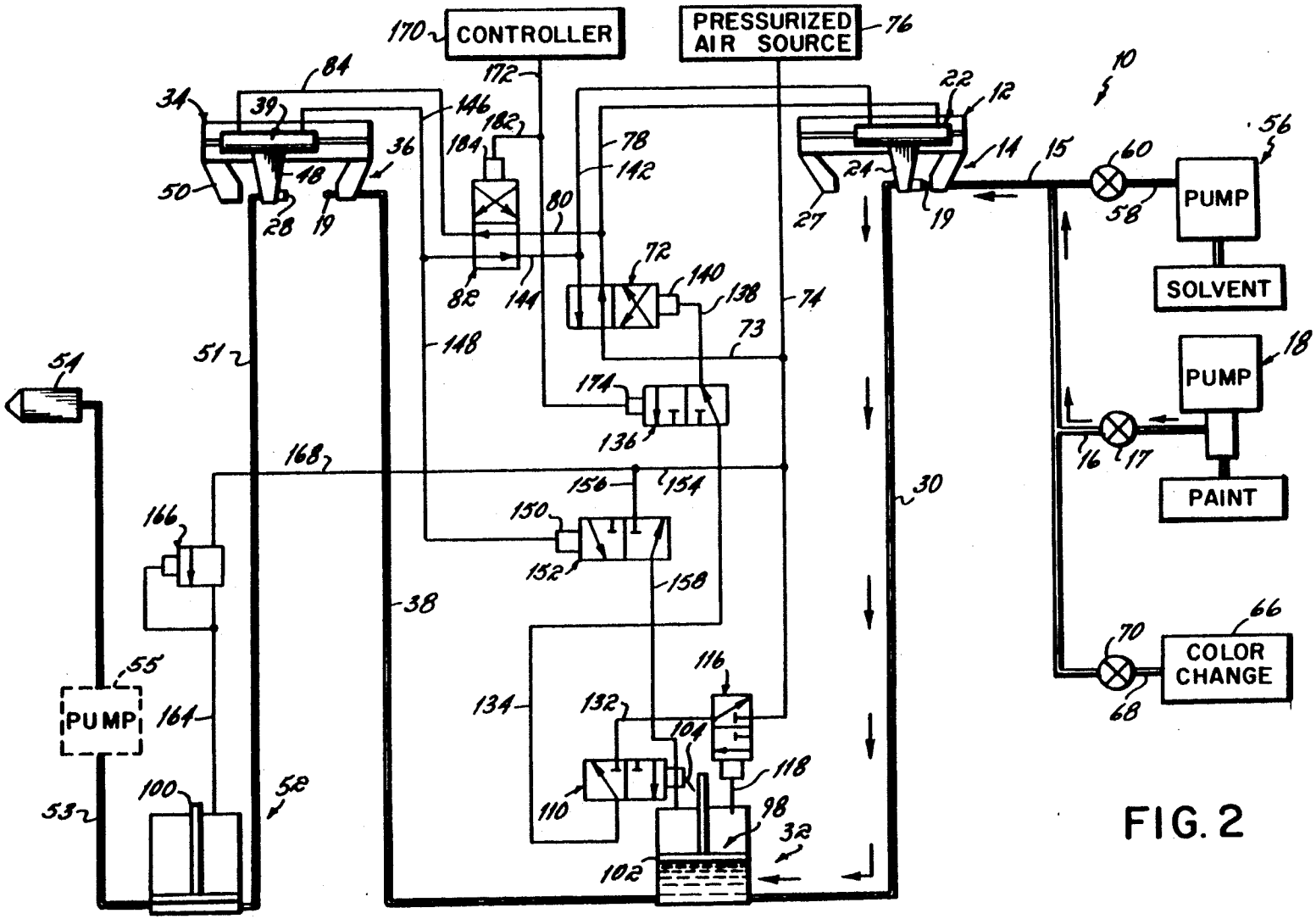
FIG. 2 is a schematic view of FIG. 1 illustrating the valving system herein in a position to fill the first piston pump.
Figure 3:
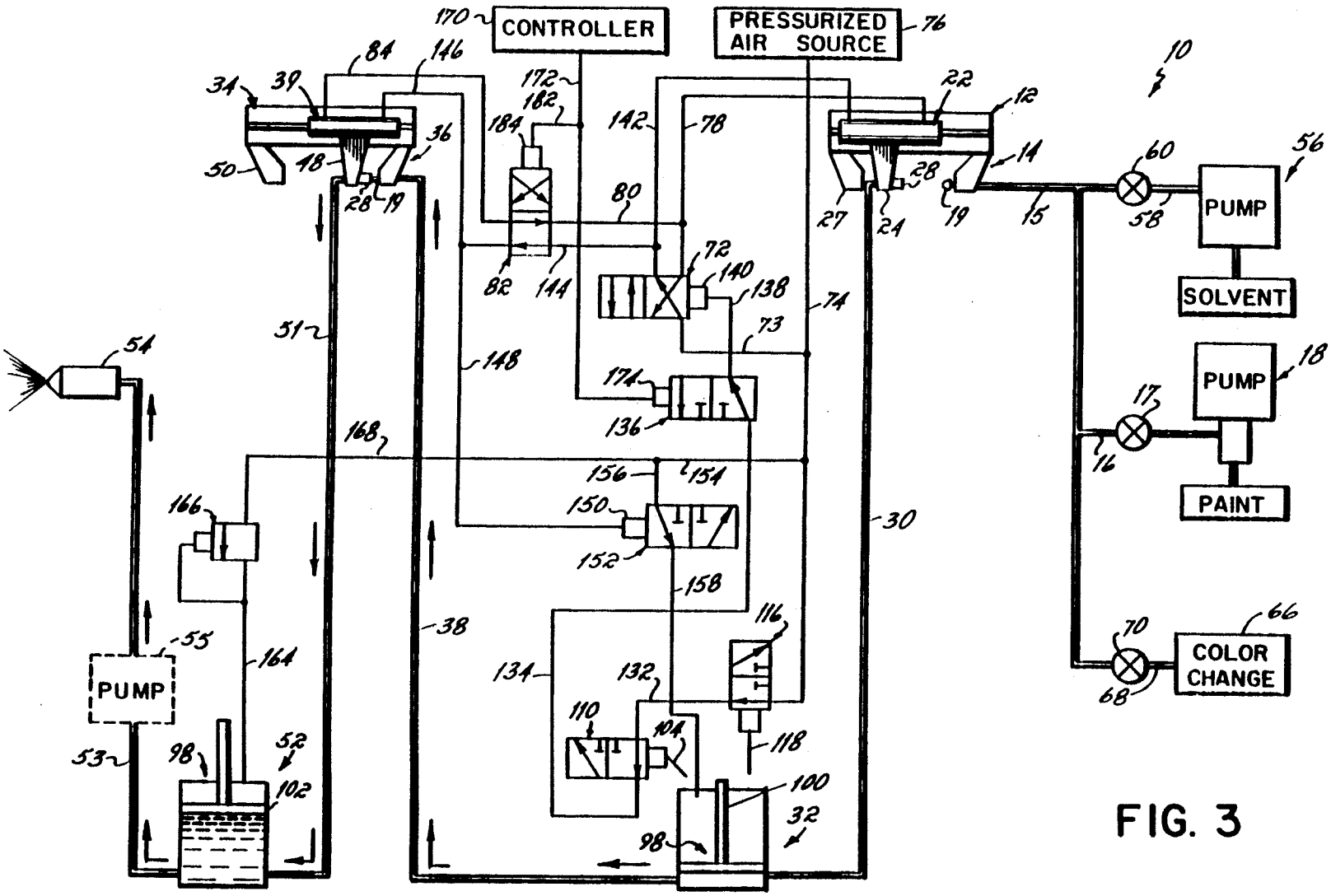
FIG. 3 is a view similar to FIG. 2 except with the valving system in a position to discharge coating material from the first pump to the second pump which in turn supplies coating material to the spray gun.
Figure 4:
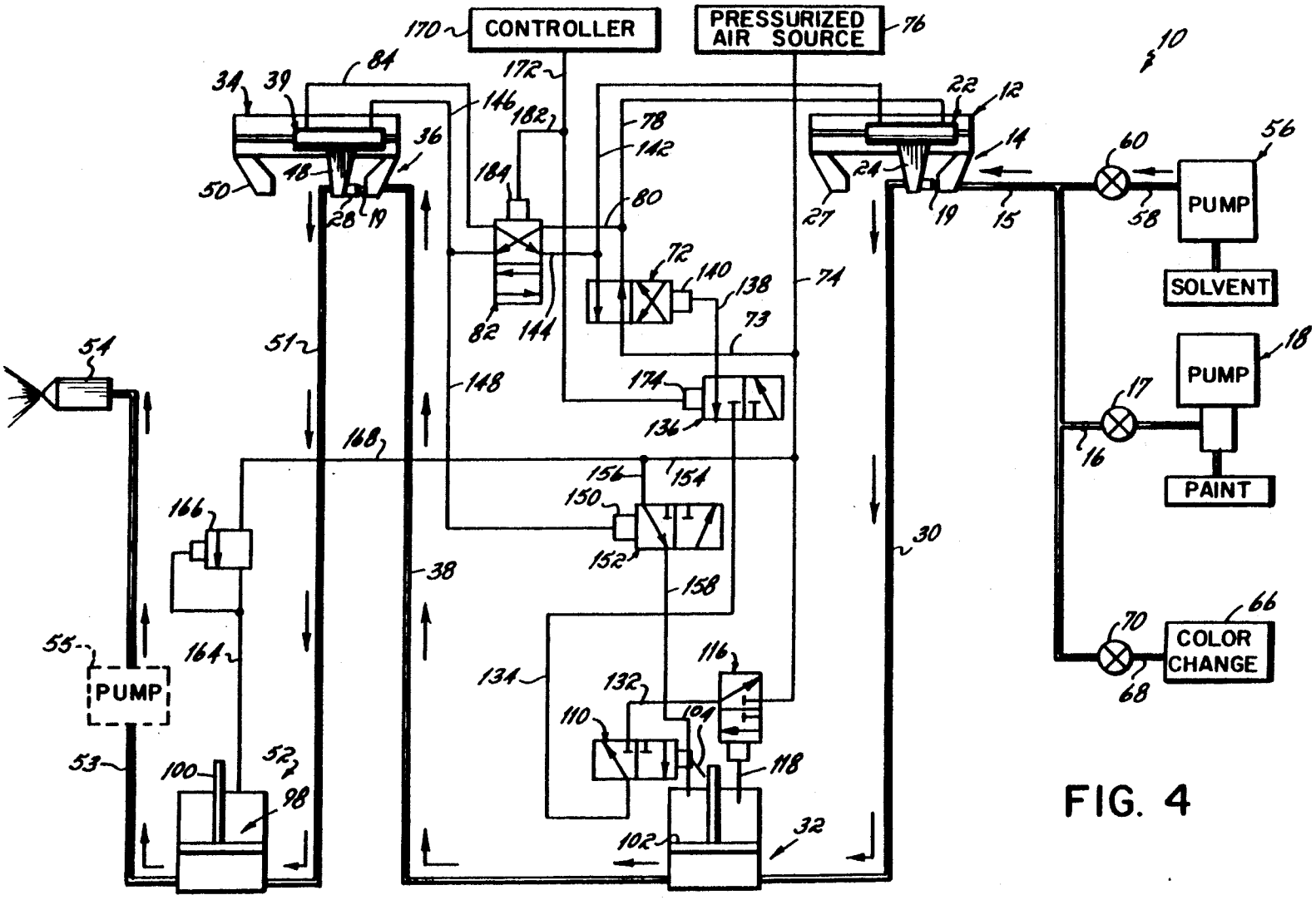
FIG. 4 is a view similar to FIGS. 2 and 3 except with the valving system in position to perform a solvent flushing operation.

Referring now to FIGS. 2, 3 and 4, a valving system is illustrated for controlling the transfer of coating material from the coating source 18 to the spray gun 54, and for solvent cleaning of all elements which carry coating material. This valving system controls three operational sequences, namely, filling of the first piston pump 32 with coating material, transfer of the coating material from first piston pump 32 through the discharge station 36 to the second piston pump 40 and spray gun 40, and finally solvent cleaning of the system. Each of these separate sequences of operation is described separately below.

Filling of Piston Pump 32

As illustrated schematically in FIG. 2, the paint supply line 16 from coating source 18 is connected to the filling station 14. The discharge station 36 is connected by the discharge line 51 to the second piston pump 52 which, in turn, leads to the spray gun 54. In order to fill the first piston pump 32 without creating an electrical path from the electrostatic spray gun 54 back to the coating source 18, a valving system is provided to move the shuttle 24 to a transfer position at the filling station 14 and simultaneously move the shuttle 48 to a spaced or neutral position relative to the discharge station 36 so that it is electrically isolated from the discharge station 36 and spray gun 54.

As viewed in FIG. 2, a pilot-operated valve 72 is connected by a line 73 to a primary air supply line 74 from a source of pressurized air 76, such as the compressor (not shown) which supplies shop air in a manufacturing facility. A first line 78 is connected at the output side of valve 72 to one side of the double-acting piston 22 which moves shuttle 24. One end of tap line 80 is connected to this first line 78, and its opposite end connects to the inlet side of a pilot-operated valve 82. A connector line 84 extends between the exhaust side of valve 82 and the double-acting piston 39 in second housing 34 which carries the shuttle 48.

In the unpiloted position of valve 72 shown in FIG. 2, pressurized air from the source 76 is allowed to flow through the lines 73 and 74 into the intake side of valve 72 and then through first line 78 to the piston 22. This pressurizes one side of the double-acting piston 22 which moves the shuttle 24 to the right as viewed in FIG. 2, into a transfer position wherein the female coupling member 28 carried by shuttle 24 engages the male coupling member 19 carried by the filling station 14. At the same time, the pressurized air flowing through first line 78 is transmitted by tap line 80 through valve 82 into the double-acting piston 39 in second housing 34. This causes the double-acting piston 39 to move the shuttle 48 to the left as viewed in FIG. 2, i.e., to a neutral position spaced from discharge station 36, so that a voltage block or air gap is provided between the discharge station 36 and shuttle 48.

With the shuttle 24 in the transfer position, and the shuttle 48 in the neutral position, paint is transmitted from the coating source 18 through the supply line 16 into the filling station 14 and then through the shuttle 24 and transfer line 30 into the first piston pump 32.

Figure 5:
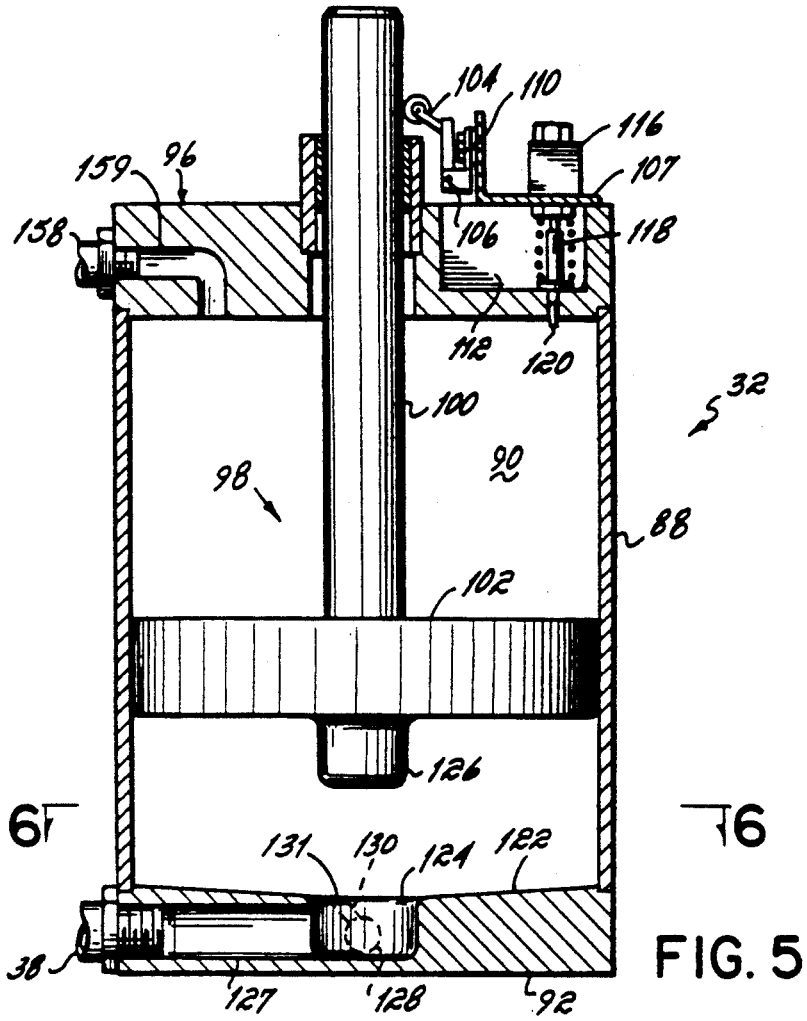
FIG. 5 is an elevational view in partial cross section of a piston pump herein.
Figure 6:
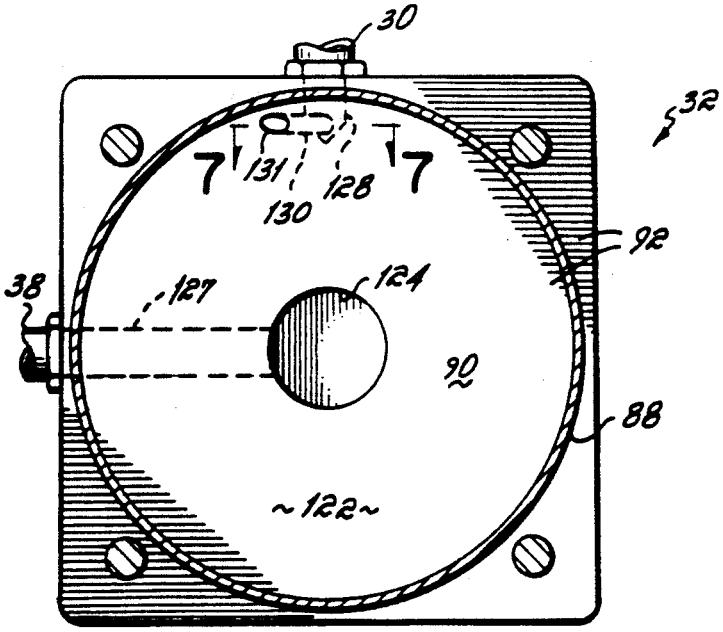
FIG. 6 is a cross sectional view of the pump taken in lines 6—6 illustrated in FIG. 5.
Figure 7:
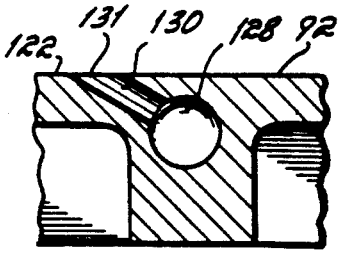
FIG. 7 is a cross sectional view taken generally along line 7—7 of FIG. 6.

With reference to FIGS. 5–7, the piston pump 32 is shown in more detail. The second piston pump 52 is identical to pump 32 and the following description is equally applicable thereto. Piston pump 32 comprises a cylindrical wall 88 defining a reservoir 90 which is closed at the bottom by a base 92 formed with a plurality of radial ribs (not shown), and is closed at the top by a cap 96. A piston 98 including a shaft 100 and piston head 102 is axially movable within the reservoir 90 between its base 92 and cap 96. The shaft 100 is engageable with a trip bar 104 pivotally mounted to a pin 106 to a bracket 107 carried by the cap 96. In response to upward movement of the shaft 100, the trip bar 104 is deflected to the right as viewed in FIG. 5 which shifts the position of a valve 110, also carried by bracket 107, for purposes to become apparent below.

The cap 96 is formed with a cavity 112 beneath the bracket 107, and a valve 116 is carried by the bracket 107 over the cavity 112. A limit switch 118 extends from the valve 116 through the cavity 112 such that the tip 120 of the limit switch 118 at least partially extends into the reservoir 90. As discussed below, when the reservoir 90 becomes filled with coating material, the piston head 102 is moved upwardly into engagement with the tip 120 of limit switch 118 to activate the valve 116.

In the presently preferred embodiment, the base 92 of piston pump 32 is formed with a dished or concavely arcuate surface 122 having a central bore 124 which mates with a projection 126 extending from the base of the piston head 102. A paint outlet 127 is formed in the base 92 which intersects the bore 124, and which has an outer end connected to the transfer line 38. The base 92 is also formed with a coating inlet 128 which is connected to a passage 130 having a discharge outlet 131 at the inner surface of the cylindrical wall 88 of pump 32. As viewed in FIG. 7, this passage 130 is oriented at an angle of about 30° relative to the cylindrical wall 88 such that paint introduced from the transfer line 30, through the inlet 128 and into passage 130 is directed tangentially into the reservoir 90 of pump 32 in a swirling flow path along the wall 88 of reservoir 90. The purpose of introducing the coating material into the reservoir 90 in this fashion is to obtain substantially continuous movement of the coating material within the reservoir 90 and thus maintain sediment and/or pigments in suspension within the coating material.

Figure 11:
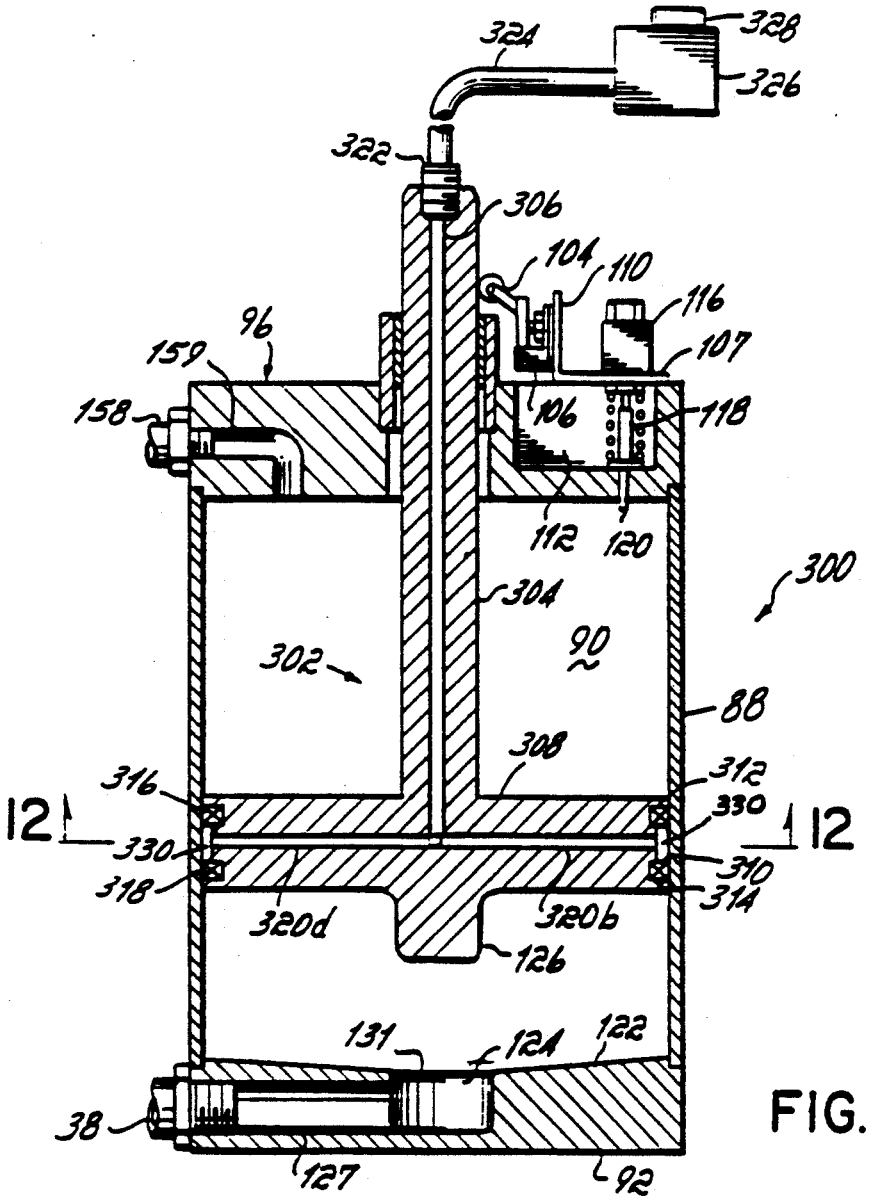
FIG. 11 is a view similar to FIG. 5 except with an alternative piston shaft and piston head configuration.
Figure 12:
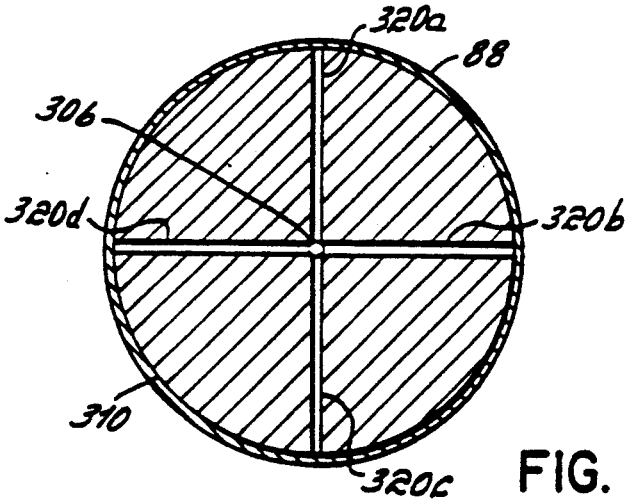
FIG. 12 is a cross sectional view taken generally along line 12—12 of FIG. 11.

An alternative embodiment of a piston pump 300 is illustrated in FIGS. 11 and 12 which is similar to that discussed above in connection with FIGS. 5–7 except as described below. Structure which is common to pumps 32 and 300 is given the same reference numbers in FIGS. 11 and 12 as in FIGS. 5–7.

In the embodiment of FIGS. 11 and 12, the piston pump 300 includes a piston 302 having a piston shaft 304 formed with a bore 306. This piston shaft 304 is connected to a piston head 308, which is essentially a circular plate having opposed sides, one of which is formed with a projection 126 as in FIG. 5. The piston head 308 also has an outer periphery 310 between the opposed sides which faces the cylindrical wall 88 of reservoir 90. In the presently preferred embodiment, the periphery 310 of piston head 308 is formed with a pair of annular grooves 312 and 314 which mount piston seals 316 and 318, respectively. The seals 316, 318 are positioned within the annular grooves 312, 314 such that they contact the inside surface of the cylinder wall 88.

As best shown in FIG. 12, the piston head 308 is formed with four branch passageways **320*a–d*, spaced about 90° apart, which extend radially outwardly from the bore 306 in piston shaft 304 to the periphery 310 of piston head 308. As viewed in FIG. 11, each of the branch passageways 320*a–d* are located between the annular grooves 312, 314 and seals 316, 318 carried by the piston head 308**.

The outer end of piston shaft 304 is formed with a threaded bore which receives a fitting 322 connected to a clear plastic tube 324 having an end cap 326 formed with a vent 328. In the presently preferred embodiment, the tube 324 and end cap 326 are filled with a liquid lubricating material, such as water, which flows by gravity therethrough into the bore 306 of piston shaft 304 and then through branch passageways **320*a–d* into an axial space 330. This axial space 330 is defined by the area between the annular grooves 312, 314 and piston seals 316, 318 carried by the piston head 308, and between the outer periphery 310 of piston head 308 and the cylindrical wall 88 of reservoir 90. The form of the lubricant reservoir shown in FIG. 11 is for purposes of illustration only and it is contemplated that the tube 324 and/or end cap 326 could be replaced with other means of conveying lubricants such as water into the piston 302** and for venting air or coating material therefrom as described below.

The provision of a liquid lubricant such as water within the axial space 330 provides a number of advantages in the operation of the piston pump 300. The water within space 330 acts as a lubricant to facilitate reciprocation of the piston head 308 along the cylinder wall 88, and to prevent drying of coating material such as paint which may remain along the cylinder wall 88 and be exposed to air on the air side of the piston head, i.e., on the upper side of the piston head 308 as viewed in FIG. 11. The water within space 330 also prevents cross contamination between the air on the upper side of piston head 308 and coating material introduced on the bottom side of piston head 308. Air which escapes past the piston seal 316 is captured within the water in space 330, and is transmitted through the branch passageways **320*a–d* and bore 306 in piston shaft 304 to the tube 324 where it escapes through the vent 328. On the other hand, coating material which escapes past piston seal 318 is collected by the water lubricant within space 330 and flows throughout the body of water located within the branch passageways 320*a–d* of piston head 308, the bore 306 of piston shaft 304 and the plastic tube 324. The presence of coating material within the water lubricant can be visually detected as it eventually flows to the tube 324, which signals to the operator that the water within tube 324, shaft 304 and piston head 308 should be changed and, possibly, that the seal 318** should be replaced.

A further advantage of directing water into the space 330 between seals 316, 318 is the elimination of a "pressure trap" therebetween. The water lubricant within space 330 is at ambient pressure. As a result, there is little or no pressure build-up in the space 330 between the seals 316, 318 which could prevent complete sealing of the seal 316 when the pressurized air is introduced above the piston head 308, and/or prevent complete sealing of seal 318 when coating material is introduced beneath the piston head 308. This allows both of the piston seals 316 and 318 to seal more efficiently, and prevents their premature wear.

Transfer of Coating Material to Spray Gun

After the first piston pump 32 has been filled with coating material as described above, the system is operated to empty the first piston pump 32 and transmit the coating material through the shuttle 48, discharge station 36, second piston pump 52 and finally to the spray gun 54. This is achieved as shown in FIG. 3. The main air line 74 connected to the pressurized air source 76 continues to the intake side of valve 116 mounted to the first piston pump 32. An exhaust line 132 extends from the discharge side of this valve 116 to the intake side of valve 110. The discharge side of valve 110, in turn, is connected by a line 134 to the intake side of a valve 136. The exhaust side of valve 136 is connected by a line 138 to the pilot 140 of valve 72.

In an initial sequence of operation, movement of the piston 98 within the reservoir 90 initially trips the trip bar 104 which shifts valve 110 to the left as viewed in FIG. 3 providing a path through the valve 110 between the exhaust line 132 and line 134. No pressurized air from the supply line 74 can pass into line 132, however, until the position of valve 116 shifts from its initial position shown in FIG. 2 to an upward position shown in FIG. 3. This upward movement of valve 116 is obtained by contact of the piston head 102 with the limit switch 118 associated with valve 116. As mentioned above, the piston head 102 moves upwardly within reservoir 90 as the reservoir 90 fills with coating material, and the piston head 102 eventually engages the limit switch tip 120 as it approaches the cap 96.

When the valve 116 is shifted upwardly to the position shown in FIG. 3, a pulse of pressurized air from the main supply line 74 passes through the valve 116 into the exhaust line 132. With the valve 110 having been shifted to the left by operation of trip bar 104 as described above, air from the exhaust line 132 passes through the valve 110 and enters line 134. The flow of air from line 134 passes through valve 136 into line 138, and then to the pilot 140 associated with valve 72. In response to the application of the pulse of pilot air, the valve 72 shifts from an initial, unpiloted position shown in FIG. 2, to the left as viewed in FIG. 3 where the valve 72 is temporarily held or latched in place until the pilot is exhausted. In this piloted position, pressurized air from lines 73 and 74 is transferred through valve 72 into a second transfer line 142 connected to the exhaust side of valve 72, while air from the double-acting piston 22 is dumped through line 78 and valve 72. This second transfer line 142 is connected to the side of the double-acting piston 22 opposite line 78. In response to pressurization of the opposite side of double-acting piston 22, the shuttle 24 is shifted from a transfer position shown in FIG. 2 to a neutral position shown in FIG. 3 wherein an air gap or voltage block is provided between the shuttle 24 and the filling station 14.

A tap line 144 is connected between second transfer line 142 and the intake side of valve 82. Pressurized air is directed through the tap line 144 and valve 82 into a transfer line 146 which extends between the exhaust side of valve 82 and the double-acting piston 39 which carries shuttle 48. This transfer line 146 is connected to the opposite side of the double-acting piston 39 than line 84 previously described, and therefore the double-acting piston 46 moves shuttle 48 in the opposite direction, i.e., the shuttle 48 is moved from the neutral position to a transfer position with respect to the discharge station 36.

A tap line 148 is connected between the transfer line 146 and the pilot 150 of a valve 152. This valve 152 is connected by lines 154 and 156 to the main air supply line 74 so that the valve 152 is supplied with pressurized air from source 76. In response to the application of pilot air via line 148 to valve 152, the valve 152 shifts to the right from its position in FIG. 2 to the position shown in FIG. 3, thus allowing passage of pressurized air from the line 156 through the valve 152 and into a pump line 158. This pump line 158 extends from the valve 152 to an inlet 159 in the cap 96 of piston pump 32 and supplies pressurized air into the top of piston reservoir 90. See FIG. 5. Pressurization of the reservoir 90 forces the piston head 102 downwardly therein, as viewed in FIG. 3, which, in turn, forces coating material from the reservoir 90 into the transfer line 38 connected to the outlet at the base 92 (FIG. 5) of piston pump 32. The coating material flows through the transfer line 38 to the discharge station 36 and then into the shuttle 48, which is now in a transfer position with respect to the discharge station 36. The coating material is transferred from the shuttle 48 through the discharge station 36 and from there into the transfer line 51 to second piston pump 52 as described above.

The structure and operation of second piston pump 52 is identical to that of piston pump 32 except that a constant supply of pressurized air is introduced into the reservoir 90 of piston pump 52 through a pump line 164 connected to a pressure regulator 166. This pressure regulator 166, in turn, is supplied with pressurized air from a line 168 connected to the main air supply line 74 from source 76. As the reservoir 90 of the second pump 54 receives coating material, its piston 98 is forced downwardly in response to the pressurized air supplied through pressure regulator 166, and the coating material is then transferred at the desired pressure through line 53 to one or more spray guns 54.

An important aspect of the above-described sequence of operation is that the shuttle 24 is moved to a neutral or electrically isolated position with respect to the filling station 14 at the same time that the shuttle 48 is moved to a transfer position with respect to the discharge station 36. This shift or movement of the shuttles 24 and 48 is triggered by the filling of first piston pump 32, as described above, which ensures that a voltage block is always maintained between the spray gun 54 and coating source 18.

Once the supply of coating material within first piston pump 32 has been exhausted from its reservoir 90, the shaft 100 of piston 98 therein moves to a fully retracted position wherein the trip bar 104 associated with valve 110 moves back to its initial position, thus allowing the valve 110 to return to the position shown in FIG. 2. Movement of valve 110 to its original, unactivated position dumps air from the pilot 140 on valve 72. With the pressure to the pilot 140 of valve 72 relieved, any remaining pilot air is exhausted through valve 72 allowing it to return to an unpiloted position wherein the exhaust side of valve 72 is connected to first line 78 instead of line 142. With the pressurization of line 78, the shuttle 24 is moved in the opposite direction, i.e., from the neutral position to a transfer position at the filling station 14 as described above. At the same time, pressurization of the line 78 causes air to flow into the tap line 80, through the valve 82 and into the connector line 84 to the opposite side of double-acting piston 39 from that illustrated in FIG. 3. In turn, the shuttle 48 is moved by piston 39 from the transfer position shown in FIG. 3 back to the neutral or electrically isolated position shown in FIG. 2. Additionally, once the flow of pressurized air through line 144 is stopped by the shifting of valve 72, the flow of air through tap line 148 is terminated, thus allowing valve 152 to return to an unpiloted position. This stops the flow of air from the air source 76 through the valve 152, and thus prevents air from flowing through line 158 to the piston pump 32. With no air pressure atop the piston pump 32 from line 158, the filling operation described above in connection with FIG. 2 can proceed to again fill the reservoir 90 of pump 32 with another charge of coating material.

Solvent Cleaning of System

In many commercial applications, it is desirable to change the color of the coating material from time to time during a production run. As mentioned above, the apparatus 10 of this invention is adapted to connect to a color changer 66 for this purpose, which is connected through the branch line 68 having a valve 70 to the main coating supply line 15. In order to change the color of the paint transmitted through apparatus 10, all of the elements which contact the paint must be cleaned with solvent or other cleaning material before the color change can take place. With reference to FIG. 4, the valving arrangement of apparatus 10 can also be sequenced to permit solvent cleaning of the paint contacting elements prior to a color change and/or at the end of a production run when the apparatus 10 will not be used for an extended period of time.

As shown in FIG. 4, pressurized air from source 76 is directed through the main air line 74 through the line 73 to the intake side of valve 72. Valve 72 is locked in an unpiloted position by the operation of a controller 170. The controller 170 directs pressurized air through a line 172 to the pilot 174 of the valve 136. When piloted, the valve 136 shifts to the right from its position shown in FIG. 2 to that shown in FIG. 4, such that the intake side thereof is connected to the line 138 from the pilot 140 of valve 72. This provides a flow path to dump air from the pilot 140 of valve 72 which locks valve 72 in the unpiloted position.

As shown in FIG. 4, with the valve 72 in an unpiloted position, its intake side is connected to line 73 and its discharge side is connected to first line 78 leading to the double-acting piston 22 carrying shuttle 24. As described above in connection with the paint filling operation, pressurization of the double-acting piston 22 through line 78 causes the shuttle 24 to move to a transfer position in engagement with the filling station 14.

The controller 170 is also connected by a line 182 to the pilot 184 of valve 82. In response to the application of pilot air, valve 82 shifts downwardly from its position shown in FIG. 2 to that shown in FIG. 4, so that the intake side of valve 82 connects to tap line 80 which, in turn, is connected to line 78. Pressurized air is therefore directed from line 78, into tap line 80 and then through the piloted valve 82 into line 146. As described above in connection with the coating discharge operation, with pressurized air flowing through line 146, the double-acting piston 46 is activated to move the shuttle 48 to a transfer position at the discharge station 36.

The controller 170 is thus operative to cause the shuttle 24 to move to a transfer position relative to filling station 14, and to cause the shuttle 48 to move to a transfer position relative to discharge station 36. This condition only occurs in response to signals from controller 170, and only for the purpose of introducing solvent through the apparatus 10. Such condition cannot occur when coating material is to be transmitted through the apparatus 10.

At the same time pressurized air is allowed to flow through line 146, the tap line 148 connected thereto sends pressurized air to the pilot 150 of valve 152. This shifts the valve 152 to the right from its position shown in FIG. 2 to that shown in FIG. 4, allowing pressurized air from the air source 76 to travel through supply line 74, branch lines 154 and 156, through the piloted valve 152 and then through pump line 158 to pressurize piston pump 32, as described below in connection with a discussion of emptying pump 32.

The cleaning operation proceeds by shutting the valves 17 and 70 associated with the coating source 18 and color changer 66, and opening valve 60 to allow the passage of solvent through line 58 into the main supply line 15. The solvent passes through the filling station 14 and shuttle 24, and then through line 30 to the piston pump 32. Because pressurized air is supplied atop the piston pump 32 as described above, the solvent flowing into the piston pump 32 is discharged therefrom through line 38 to the discharge station 36 and shuttle 48. From the shuttle 48, the solvent travels through line 51 to the second piston pump 52 and then through line 53 to the spray gun 54. In this manner, all of the elements of apparatus 10 which come into contact with paint are cleaned with solvent.

COUPLING DEVICE

Figure 8:
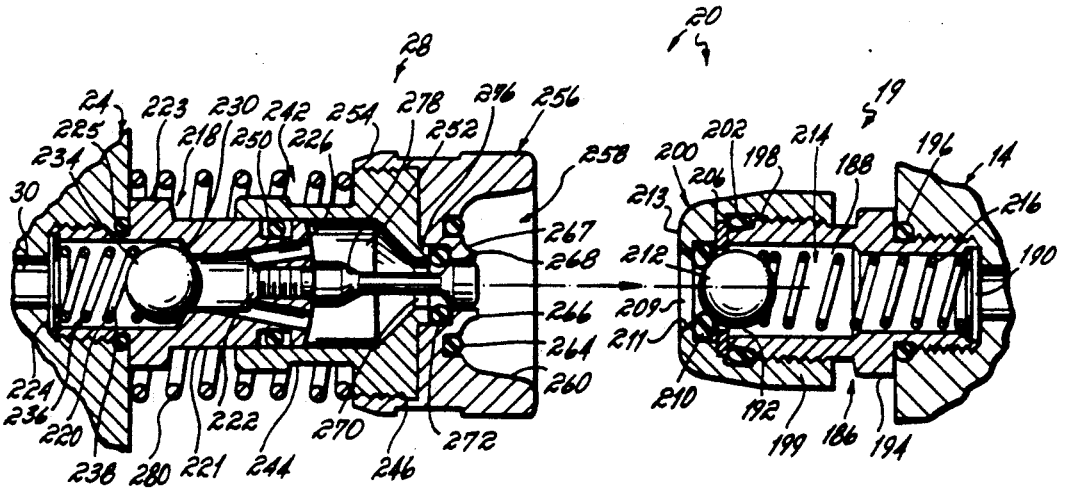
FIG. 8 is a cross sectional view of the coupling device employed herein in a disengaged
Figure 9:
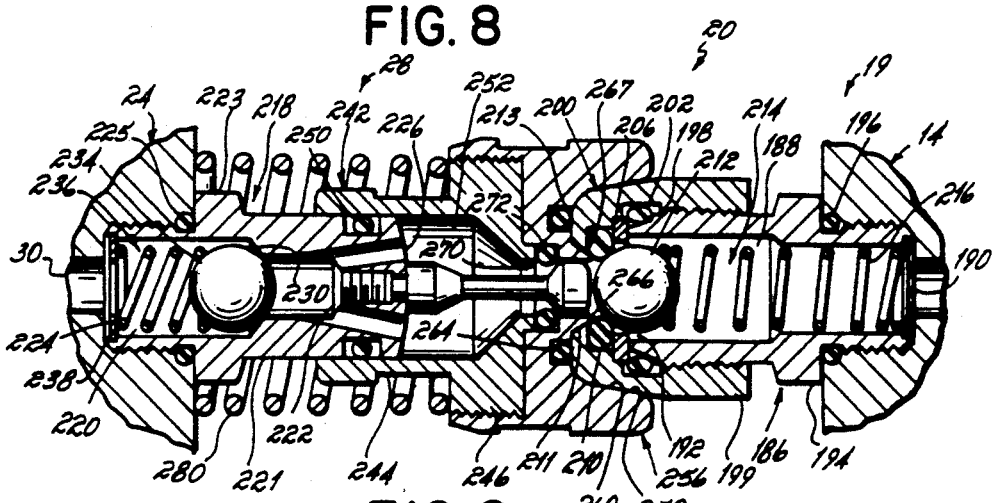
FIG. 9 is a view similar to FIG. 8 except with the male and female coupling members initially engaged with one another.
Figure 10:
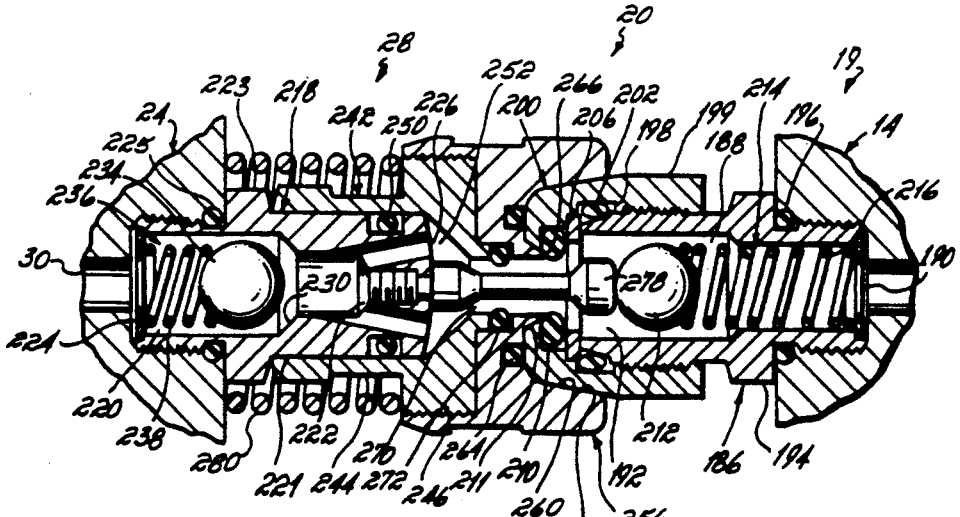
FIG. 10 is a view similar to FIGS. 8 and 9 except with the coupling members in position to permit the flow of coating material therethrough.

With reference now to FIGS. 8–10, the coupling device 20 associated with each of the shuttles 24 and 48 is illustrated in detail. As mentioned above, each coupling device 20 includes a male coupling member 19 preferably carried by the filling station 14 and discharge station 36, and a female coupling member 28 preferably carried by the shuttles 24, 48. For purposes of the present discussion, the coupling device 20 associated with the shuttle 24 and filling station 14 is described in detail, it being understood that the coupling device 20 for shuttle 48 and discharge station 36 is identical in structure and operation.

In the presently preferred embodiment, the male coupling member 19 comprises a cylinder 186 having a passageway 188 formed with an inlet end 190 and an outlet end 192. The outer wall of cylinder 186 is threaded adjacent the inlet end 190 and flats 194 extend outwardly from cylinder 186 so that the cylinder 186 can be threaded into engagement with the filling station 14 and coupled to a fitting (not shown) which carries one end of the main coating line 16. An O-ring 196 is preferably interposed between the flats 194 and filling station 14 to create a fluid-tight seal therebetween.

The cylinder 186 is received within a cavity 198 formed in a retainer 200. Preferably, the outer surface of the cylinder 186 at its outlet end 192 is threaded to mate with threads on the wall 199 defined by the cavity 198 of retainer 200. The retainer wall 199 is formed with a recess which carries an O-ring 202, a seat which carries a ring 206 and a second seat formed at the outlet 209 of cavity 198 which carries an O-ring 210. Preferably, the outlet 209 in retainer 200 has a radially outwardly tapered or flared annular edge 211 which terminates at a flat, outer surface 213 of the retainer 200.

In the assembled position, the inner end of cylinder 186 contacts the ring 206 of retainer 200, and the O-ring 202 carried within retainer wall 199 sealingly engages the outer wall of cylinder 196 at such inner end. The ring 206 retains the O-ring 210 in position upon its seat, and this O-ring 210 forms a seal for the ball 212 of a one-way valve 214 carried within the passageway 188 of the cylinder 186. The ball 212 is connected to one end of a spring 216 which urges the ball 212 against the O-ring 210. The opposite end of spring 216 is fixedly mounted to the cylinder 186 at the inlet end 190 thereof.

The female coupling member 28 is illustrated at the lefthand portion of FIG. 8. The female coupling member 28 comprises a fixed element, i.e., post 218, formed with a stepped passageway 220 having an inlet end 222 and an outlet end 224. The stepped passageway 220 defines a post wall 221 having an outer surface which is threaded at the inlet end 222 of passageway 220 to engage mating threads of the shuttle 24. Flats 223 are formed on the post wall 221 to assist in fixedly connecting the female coupling member 28 to shuttle 24. An O-ring 225 is interposed between the post 218 and shuttle 24 to create a fluid-tight seal therebetween. Once in a fixed position on shuttle 24, the outlet end 224 of the passageway 220 in female coupling member 28 is connected to the transfer line 30 leading to piston pump 32.

In the presently preferred embodiment, the inlet end 222 of stepped passageway 220 is connected to branch passageways 226, each oriented at an angle to the axis of stepped passageway 220. A seat 230 is formed in the post wall 221 defined by passageway 220, and this seat engages the ball 234 of a one-way valve 236 carried within the passageway 220. The ball 234 is urged into engagement with the seat 230 by a spring 238 fixedly connected to the post wall 221 at the outlet 224 to stepped passageway 220.

The female coupling member 28 also includes a two-part movable element in addition to the fixed post 218. One part of this movable element comprises a sleeve 242 formed with a cylindrical flange 244 connected to a head section 246. The cylindrical flange 244 of sleeve 242 slidably engages the outer surface of the post wall 221 and a recess carrying an O-ring 250 is provided on the outer surface of post wall 221 to form a seal with the cylindrical flange 244. With the sleeve 242 in place upon the post wall 221, a suction cavity 252 is formed within the sleeve 242 and the volume of this suction cavity 252 is defined by the position of the fixed post 218 therein as described below.

The head section 246 of sleeve 242 has a threaded outer surface mounted to the annular extension 254 of a collar 256, which forms the second part of the movable element of female coupling member 28. The collar 256 is formed with a cavity 258 shaped to receive the retainer 200 of male coupling member 19, as described below. The outer wall 260 of collar 256 defined by cavity 258 includes a recess carrying an O-ring 264, and an annular rib 266 located at the outer end of a central bore 268 formed in collar 256. This central bore 268 aligns with the inlet 270 to suction cavity 252 formed in the sleeve 242. In the assembled position of sleeve 242 and collar 256, the head section 246 of sleeve 242 engages the base of collar 256, and an O-ring 272 carried within a seat formed in collar 256 contacts an annular projection 276 of the sleeve head section 246 to create a seal therebetween.

In the presently preferred embodiment, a valve actuator 278 is threadedly mounted in the fixed post 218, in between the branch passageways 226. This valve actuator 278 extends through the suction cavity 252 in sleeve 242, and into the central bore 268 of collar 256. Additionally, a heavy coil spring 280 extends between the shuttle 24 and the head section 246 of sleeve 242. As mentioned above, the sleeve 242 and collar 256 are axially movable with respect to the fixed post 218, and the coil spring 280 is operative to return the sleeve 242 and collar 256 into position when the male and female coupling members 19 and 28 are uncoupled as described below.

The construction of coupling device 20 is particularly intended to create a fluid-tight seal when the male and female coupling members 19, 28 engage one another, and also to prevent the drippage of coating material from such coupling members 19, 28 when they are disengaged. A three-part seal is provided between the male and female coupling members 19, 28 to avoid leakage when such elements are engaged, and a suction or negative pressure is created within the suction chamber 252 of the female coupling member 28 when it disengages the male coupling member 19 to prevent drippage of coating material at the outer portions thereof.

With respect to the seal created within the coupling device 20 when the male coupling member 19 and female coupling member 28 engage one another, reference is made to FIG. 9 wherein the male coupling member 19 and female coupling member 28 have initially engaged one another. In this position, the retainer 200 is received within the cavity 258 of collar 256 and a primary seal is created between the annular rib 266 of the collar 256 in female coupling member 28, and the large O-ring 210 carried at the outlet 209 of the retainer 200. A secondary seal is created between the flat, outer surface 213 of the retainer 200 and the O-ring 264 carried in the recess within the outer wall 260 of collar 256. A third or tertiary, metal-to-metal seal is created between a tapered surface 267 of the annular rib 266 of collar 256, and the flared annular edge 211 of the retainer 200 at its outlet 209. This three-part seal ensures that no coating material can leak from between the male and female coupling members 19, 28 during a coating transfer operation.

With reference to FIG. 10, the male and female coupling members 19, 28 are illustrated in a position wherein coating material is transferred from the male coupling member 19 into and through the female coupling member 28. After the coupling members 19, 28 initially contact one another, further movement of the shuttle 24 with respect to the filling station 14 causes the valve actuator 278 of the female coupling member 28 to contact the ball 212 of one-way valve 214 within the male coupling member 19 and disengage the ball 212 from O-ring 210. This forms a flow path through the passageway 188 of cylinder 186, through the outlet 209 of retainer 200 and into the suction cavity 252 of the sleeve 242. From the suction cavity 252, the coating material enters the branch passages 226 in the fixed post 218 and then flows into the stepped passageway 220. The coating material has sufficient pressure to unseat the ball 234 of one-way valve 236 within the passageway 220 of fixed post 218, and thus it flows through the outlet 224 of stepped passageway 220 into the line 30 leading to the first piston pump 32.

An important aspect of this invention is predicated upon the concept of creating a suction within the suction cavity 252 to avoid drippage or loss of coating material in the area of the mating portions of coupling members 19, 28 when they are disengaged. This suction is created by movement of the sleeve 242 relative to the fixed post 218. As viewed in FIG. 9, with the male and female coupling members 19, 28 initially contacting one another, the volume of suction cavity 252 within sleeve 242 is relatively large. This is because the heavy coil spring 280 retains the sleeve 242 and collar 256 near the outermost end of the fixed post 218. In the course of movement of the male and female coupling members 19, 28 toward one another, the fixed post 218 enters further into the suction cavity 252 and the coil spring 280 is compressed. See FIG. 10. Upon disengagement of the male and female coupling members 19, 28, the coil spring 280 forces the sleeve 242 and collar 256 outwardly with respect to the fixed post 218, thus increasing the volume of suction cavity 252. As sleeve 242 and collar 256 move outwardly, valve actuator 278 moves past O-ring 210 which has a smaller inner diameter than the outer diameter of the tip of valve actuator 278 so that a momentary seal is created therebetween. This momentary seal prevents further flow of coating material through passageway 192 at the same time the suction cavity 252 is increasing in volume. Relative movement between the fixed post 218 and sleeve 242 creates a suction or negative pressure within suction cavity 252 which pulls ball 234 against its seat 230 thus preventing backflow of coating material from passageway 220. With flow from passageway 192 blocked by the seal between valve actuator 278 and O-ring 210, and the flow from passageway 220 blocked by ball 234, the negative pressure created within suction cavity 252 is effective to draw coating material from the outer areas of male coupling member 19, and from the area of the cavity 252 and collar 256 of female coupling member 28, into the suction cavity 252. This substantially reduces or prevents drippage of the coating material from these areas which otherwise might fall onto the apparatus 10.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the piston pump 300 of the embodiment illustrated in FIGS. 11 and 12 is depicted as an air-actuated pump in which pressurized air is employed to move the piston head 308 to force coating material from the reservoir 90. It should be understood that the piston head and piston shaft construction of such embodiment could also be employed in a "double-acting" pump wherein fluid such as paint is pumped during both directions of movement of piston head 308, in which case the "operating fluid" which cause movement of the piston head 308 is considered to be the same material as the fluid to be pumped during a portion of a pumping cycle. Additionally, it should be understood that the piston shaft 304 could be eliminated, if desired, so long as structure is included which provides a flow path between the branch passageways 320*a–d* of piston head 308 and the exterior of reservoir 90.

Therefore, it is intended that the invention not be limited to the particular embodiment disclosed as the best mode contemplated for carrying out this invention, but that the invention will include all embodiments falling within the scope of the appended claims.

We claim:

1. Apparatus for transmitting electrically conductive coating material from a source to an electrostatic coating dispenser, comprising:

a piston pump, including:

(i) a pump wall having opposed ends which define an internal reservoir;

(ii) a piston head movable along said pump wall within said reservoir, said piston head having opposed sides and an outer periphery carrying a pair of seals which are spaced from one another;

(iii) means connected to said piston head and communicating exteriorly of said reservoir for introducing a liquid into said space between said seals carried by said piston head;

first transfer means for transferring coating material from the source into said reservoir of said piston pump on one side of said piston head;

second transfer means for transferring coating material from said reservoir of said piston pump to the electrostatic coating dispenser, said second transfer means including means for introducing operating fluid into said reservoir of said piston pump on the other side of said piston head to force the coating material from said reservoir;

means for electrically isolating said second transfer means from the electrostatic coating dispenser while transferring coating material into said reservoir of said pump; and means for electrically isolating said first transfer means from the source while transferring coating material from said reservoir of said pump to said electrostatic coating dispenser.

2. The apparatus of claim 1 in which said means for introducing a liquid into said space between said seals of said piston head is effective to lubricate said piston head as it moves along said pump wall, and to substantially prevent drying of coating material on said pump wall.

3. The apparatus of claim 1 in which said means for introducing a liquid into said space between said seals of said piston head is effective to substantially remove coating material or operating fluid from said space between said seals of said piston head.

4. The apparatus of claim 1 in which said means for introducing a liquid into said space between said seals of said piston head is effective to relieve fluid pressure within said space between said seals of said piston head created by the passage of operating fluid or coating material into said space.

5. The apparatus of claim 1 in which said means for introducing a liquid into said space between said seals of said piston head comprises:

a piston shaft formed with a bore, said piston shaft being connected to said piston head and having an end extending exteriorly of said reservoir;

at least one passageway formed in said piston head which extends between said bore in said piston shaft and said outer periphery of said piston head between said spaced seals therein;

means for introducing a liquid into said bore in said piston shaft, through said passageway in said piston head and into said space between said seals on said piston head.

6. The piston pump of claim 5 in which said means for introducing a liquid comprises a tube connected to said piston shaft in communication with said bore therein, and a vented cap mounted to said tube, said tube and said vented cap being adapted to be filled with said liquid.

* * * * *